US005305526A

United States Patent [19]

Althaus

[11] Patent Number: 5,305,526

[45] Date of Patent: * Apr. 26, 1994

[54] RAZOR HEAD, ESPECIALLY RAZOR BLADE UNIT OF A WET RAZOR

[75] Inventor: Wolfgang Althaus, Wuppertal, Fed. Rep. of Germany

[73] Assignee: Wilkinson Sword Gesellschaft mit beschränkter Haftung, Solingen, Fed. Rep. of Germany

[ * ] Notice: The portion of the term of this patent subsequent to Nov. 12, 2008 has been disclaimed.

[21] Appl. No.: 877,438

[22] Filed: Apr. 30, 1992

[30] Foreign Application Priority Data

Feb. 14, 1992 [EP] European Pat. Off. ..... 92710005.7

[51] Int. Cl.[5] ..... B26B 21/14; B26B 21/54

[52] U.S. Cl. ..... 30/77; 30/346.54

[58] Field of Search ..... 30/77, 41, 346.53, 346.54, 30/346.58, 350

[56] References Cited

U.S. PATENT DOCUMENTS

| | | | |
|---|---|---|---|
| 3,281,287 | 10/1966 | Edstrohm et al. . | |
| 3,501,334 | 3/1970 | Flaherty | 30/346.54 |
| 3,838,512 | 10/1974 | Sanderson | 30/346.54 |
| 4,259,126 | 3/1981 | Cole et al. | 30/346.54 |
| 5,056,221 | 10/1991 | Thoene | 30/41 |
| 5,063,668 | 12/1991 | Althaus | 30/77 |
| 5,095,620 | 3/1992 | Althaus | 30/41 |

FOREIGN PATENT DOCUMENTS

| | | | |
|---|---|---|---|
| 0389007 | 1/1987 | European Pat. Off. . | |
| 0453717 | 2/1991 | European Pat. Off. . | |
| 1553631 | 4/1970 | Fed. Rep. of Germany | 30/346.54 |
| 2750796 | 11/1977 | Fed. Rep. of Germany . | |
| 1496540 | 10/1966 | France . | |
| 89/09121 | 10/1989 | PCT Int'l Appl. . | |
| 1020202 | 2/1966 | United Kingdom | 30/346.54 |
| 1162757 | 3/1967 | United Kingdom . | |
| 1133535 | 8/1967 | United Kingdom . | |
| 1099017 | 1/1968 | United Kingdom | 30/346.54 |
| 1306260 | 2/1973 | United Kingdom | 30/346.54 |

*Primary Examiner*—Richard K. Seidel
*Assistant Examiner*—Hwei-Siu Payer
*Attorney, Agent, or Firm*—Robert W. Becker

[57] ABSTRACT

To reduce the frictional resistance of a wet razor head, especially a razor blade unit thereof, as well as to provide a sharper blade without the risk of injury, there is provided a combination of a protective wire that covers a blade made of a steel strip having a width of less than 5 mm, a thickness between 0.05 and 0.25 mm, and a chromium/molybdenum steel composition having a hardness of greater than 620 HV and a retained austenite content of less than 32%, with the blade being a single piece that has no perforations or holes and that is mounted in a vibration-free manner in a plastic body. The protective wire comprises loops that are spaced greater than 2 mm but less than 5 mm apart and that have a minimum thickness of greater than 0.1 mm to form a protective guard over the razor blade with the effect of a protective foil.

8 Claims, 1 Drawing Sheet

RAZOR HEAD, ESPECIALLY RAZOR BLADE UNIT OF A WET RAZOR

BACKGROUND OF THE INVENTION

The present invention relates to a razor head, especially a razor blade unit that is to be disposed at the front end of a handle of a wet razor. The razor head includes a plastic body having a front guide strip and a rear protective cover. Either a single or twin blades made of steel are fixedly disposed in the plastic body. The razor blade or blades are protected by a protective wire that extends over the cutting edges. The protective cover can be provided with a glide strip.

Various embodiments of wet or safety razors are known. In each case, disposed at the front end of a handle is a razor head that carries a single or double razor blade. The razor head can be integrally formed with the handle as a molded plastic part. If the razor head is separate from the handle and is to be secured thereto in an exchangeable manner via an appropriate mechanism, it is designated as a so-called razor blade unit, with a single or double razor blade being fixedly embedded in a plastic body or housing. The razor blade unit can be connected to the handle from a dispenser in a one-handed operation to form the complete razor. After use, the razor blade unit can again be separated from the handle and a new razor blade unit can be taken up via the coupling mechanism.

A razor head in the form of such a razor blade unit of the aforementioned general type is disclosed in applicant's U.S. Pat. No. 5,063,668, according to which twin razor blades are embedded in a basic plastic body via a positive connection. The razor blades are wrapped with a wire in such a way that windings thereof are spaced from one another and extend parallel to one another, with the windings extending over the cutting edges of the razor blades at right angles and representing a protection from injury. The protective wire furthermore provides a fixing connection between the twin blades and the plastic body. The protective wire winding significantly improves the shaving characteristics by not only reducing frictional resistance during the shaving process, but also by avoiding injury to the skin, even in non-visible areas, by preventing the skin from folding or bulging ahead of the cutting edges.

Finally, the protective wire prevents a user from accidentally cutting himself on the cutting edges during improper handling of the razor blade unit.

The known razor blade unit has razor blades that are made from standard razor blade steel having a carbon content of about 0.67% by weight, a chromium content of about 13% by weight, and a manganese content of 0.6% by weight. Unfortunately, not only the corrosion resistance of this razor blade steel but also the shaving characteristics of the blades produced therefrom leave something to be desired, so that additional coating treatments are required. Even then, neither is the corrosion problem resolved, nor is it possible by appropriately sharpening the blades to ensure a smooth and gentle shave. This also makes the basic problem acute, namely that the provision of sharper blades also involves an increase in the risk of injury.

It is therefore an object of the present invention to improve a razor blade unit of the aforementioned general type in such a way that the frictional resistance is considerably reduced, thereby providing the possibility of making the cutting edges of the blades sharper than was previously possible, and on the whole to ensure an even smoother and gentler sliding of the blades over the skin without the risk of injury.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
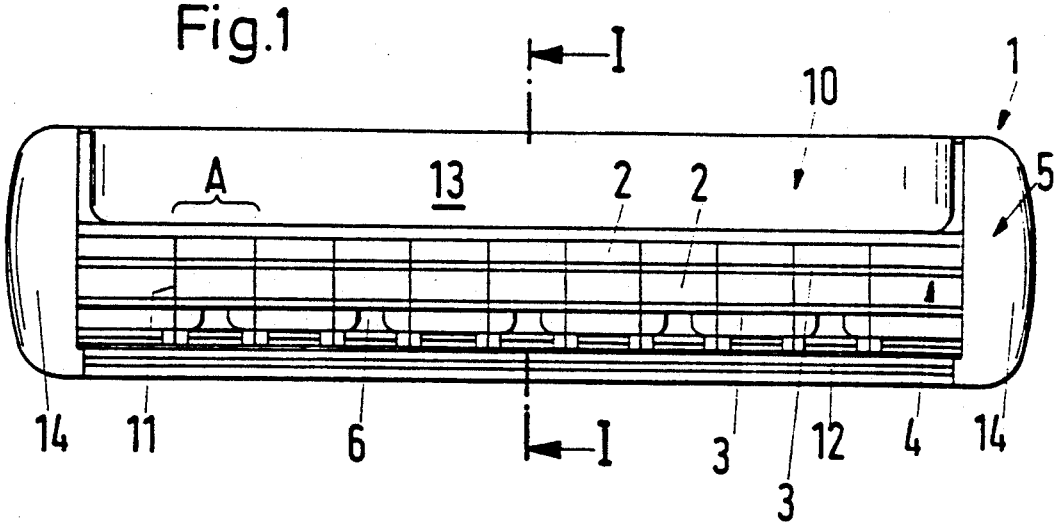
FIG. 1 is a top view of one exemplary embodiment of the inventive razor blade unit.
Figure 2:
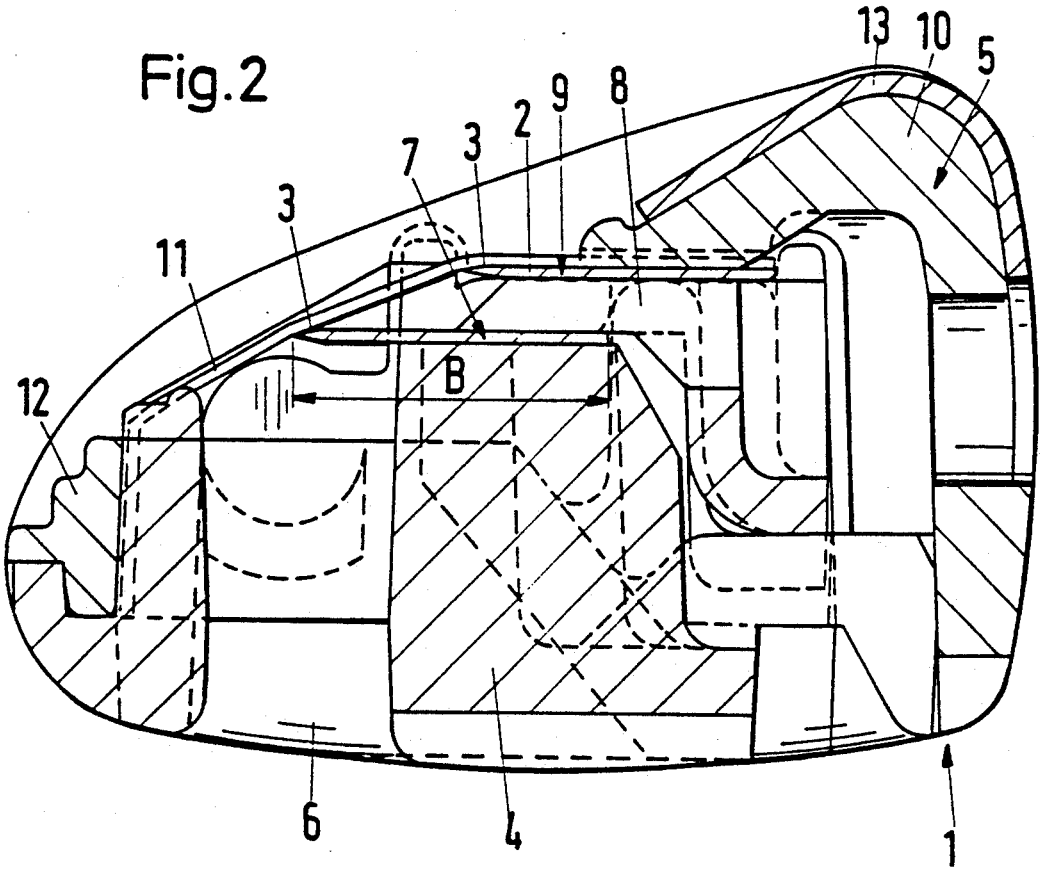
FIG. 2 is a cross-sectional view taken along the line I—I in FIG. 1.

The razor head of the present invention is characterized primarily in that the blades are made from a steel strip having a width of less than 5 mm, a thickness between 0.05 and 0.25 mm, and a chromium/molybdenum steel composition having a hardness of greater than 620 HV (Vickers hardness) and a retained austenite content of less than 32%, with each blade being a single piece that has no perforations, bores, or similar holes and that is mounted in a vibration-free manner in the plastic body; and in that the protective wire comprises a wire loop arrangement, with individual loops thereof being spaced greater than 2 mm but less than 5 mm apart and having a minimum thickness of greater than 0.1 mm to form a protective guard means over the razor blades with the effect of a protective foil.

By using such a razor blade steel, it is possible to manufacture the blades from a steel strip without perforations or holes and to mount them in the plastic body in a vibration-free manner. As a consequence of the combination of such razor blades with a specific arrangement of the protective wire in the form of a protective guard it is now possible to make the cutting edges of the blades exceptionally sharp without the need for a metallic or ceramic coating, and it is also possible, together with the vibration-free mounting of the blades, to ensure a smooth and thorough shave, whereby the protective guard formed by the loop arrangement not only serves to absolutely protect the skin during shaving, but also improves the sliding characteristics by reducing the frictional force and prevents the formation of skin bulging ahead of the razor, as is achieved with dry razors via the protective foil that is disposed over the cutting edges.

The term "protective foil effect" in conjunction with the inventive wet razor head clearly shows a protective guard arrangement over the cutting edges of the razor blades via which the skin that is to be shaved is prevented from folding or bulging too deeply in the cutting edge zone and thereby being subjected to the risk of injury. Rather, the inventive arrangement ensures that over the length of the cutting edges the skin is always maintained at a controlled and safe distance relative to the cutting edges, with the plurality of loops of the protective guard keeping the skin taut so that no bulges that could extend to the cutting edges occur. The cutting edge is uniformly divided over the entire length of the blade into a plurality of smaller blade portions which on the one hand provide an exceptionally favorable preparation for the shave by means of the protective guard, as well as avoiding any cutting, and on the other hand raises the hair that is to be cut from the surface of the skin into the blade zone due to the tautness of the skin. In order to achieve such a "protective foil effect" using a protective wire that is embodied as a protective guard, the spacing between the loops thereof must be neither too small nor too great, and the wire must also have a certain thickness.

The protective guard is preferably made using a protective wire the loops of which are spaced from one another over the blades by approximately 3 mm, with the steel strip of the blade having a width of less than 3 mm and a thickness of 0.1 mm.

The razor blade steel is preferably characterized by the following alloy composition:

0.45 to 0.55% by weight carbon,
12.00 to 14.00% by weight chromium,
0.40 to 1.00% by weight silicon,
0.50 to 1.00% by weight manganese,
1.00 to 1.60% by weight molybdenum,
the remainder being iron and inevitable impurities, with the steel preferably being austenized by heating to a temperature between 1075° and 1120° C. and hardened by cooling to a temperature between −60° and −80° C., and subsequently tempered at a temperature between 180° and 400° C. until a hardness of greater than 620 HV is obtained. With this steel it is possible to attain an exceptionally sharp blade without the need for a metallic or ceramic coating, with this quality being maintained throughout the life of the blade in the cutting area due to the exceptional corrosion resistance even in the micro range.

The razor blade steel is preferably characterized by the following alloy composition:

| | |
|---|---|
| carbon | 0.5% |
| chromium | 13.58% |
| silicon | 0.90% |
| manganese | 0.79% |
| molybdenum | 1.30% |

the remainder being iron and inevitable impurities.

A polytetrafluoroethylene or silicone layer, which reduces the side or surface friction, can additionally be sintered with the steel strip.

Further advantages are achieved with the inventive blade steel if the retained austenite decreases with the material depth, ranging from 24 to 32% at the surface and between 6 and 14% at a depth or level of 50 μm below the surface, with the carbide proportion in the structure being 100 to 150 carbides per 100 $\mu m^2$. With the proposed steel, it is possible for the first time to produce razor blades that have a superior corrosion resistance, blade edge and sharpness, so that penetration into the hair of the beard with less force and a more thorough shave are possible.

The protective guard over the single or twin blades works in combination with the steel thereof; the protective guard or loop arrangement preferably comprises several individual parallel wire loops that are arranged exclusively over the blades and are made of stainless steel X 46 Cr 13 of quality 1.4034 of the steel industry code of 1989. Due to the spacing between the individual wire loops, which must be neither too narrow nor too wide, the desired protective foil effect is achieved. Without resulting in any uncomfortable feeling while shaving, the skin is held back and stretched by the protective guard or loop arrangement, with the beard hairs being contacted completely by the cutting edges and hence making it possible to carry out a smooth and gentle shave while maximizing protection of the skin.

Pursuant to a further expedient embodiment of the present invention, the glide strip on the protective cover of the razor blade unit is convexly curved so that the back side of the razor blade unit and the transition or intermediate area of the cover are also covered. In this way, the frictional resistance is reduced further and the gliding and shave qualities that were increased by the sharpness of the blades and by the protective guard are improved even more. A xerogel is preferably used as a lubricant in the glide strips, with this xerogel, when it receives water as a dispersion medium, being converted into a lyogel that is very lubricious on the skin of a user and has a coefficient of friction $\mu$ of less than 0.25. This lubricant does not dissolve out of the glide strip when it comes into contact with water, so that the lubricity is maintained over the entire life of the blades (see U.S. Pat. Nos. 5,056,221 and 5,095,620, the disclosures of which are hereby incorporated herein by this reference thereto).

Further specific features of the present invention will be described in detail subsequently.

DESCRIPTION OF PREFERRED EMBODIMENTS

Referring now to the drawing in detail, shown is a razor head in the form of a razor blade unit for a wet razor; this razor blade unit can be secured to the front end of a non-illustrated handle, and comprises a plastic body 1 in which are disposed two razor blades 2, the cutting edges 3 of which extend parallel to one another and are disposed one behind the other.

The plastic body 1 comprises a base part 4 for the razor blades 2 and an upper part 5 that is disposed on the base part 4. The inner portion of the base part 4 of the plastic body 1 is provided with through slots 6 that permit a free flow of water during rinsing of the razor blade unit for cleaning the blades. The upper side of the base part 4 defines a platform 7 for the razor blades 2. Sandwiched between the two razor blades 2 is a spacer 8 to which the razor blades 2 are fixedly connected. This razor blade/spacer/razor blade unit 9 is disposed on the platform 7 of the base part 4 and is then covered from above by a cover cap or protective cover 10 so that the unit 9 is fixedly integrated with the plastic body 1.

The razor blades 2 comprise a corrosion-resistant chromium-molybdenum-steel alloy of 0.50% carbon, 13.58% chromium, 0.90% silicon, 0.79% manganese, 1.3% molybdenum, with the remainder being iron and inevitable impurities. This composition or alloy is austenized at a temperature of 1090° C. and is held at this temperature for 30 to 40 seconds, and for hardening is quenched at a temperature of −70° C. The steel is in the form of a steel strip having a width B=3 mm and a thickness of 0.1 mm. From this steel strip, the blades are formed in one piece without perforations, bores, or similar holes, and are fixedly connected, free of vibration, with the base part 4 for the front blade and with the spacer 8 for the rear blade. The blades 2 are provided with a non-illustrated, sintered-on polytetrafluoroethylene or silicone layer that reduces side or surface friction.

Disposed over the razor blades 2 is a protective guard means or loop arrangement 11 that comprises ten individual guards 11 of high quality steel wire having a diameter of greater than 0.1 mm. The guards 11 are disposed parallel to one another and are spaced from one another by a distance A of between 2 and 3 mm, with the guard 11 extending at right angles to the cutting edges of the blades. In the illustrated embodiment, the protective guard means 11 are individually connected to the base part 4, the upper blade 2, and the upper part 5, but can also be formed by a single zigzagged wire in a known manner.

The upper part 5 is a single plastic component and is provided with a front guard bar or guide strip 12. This guide strip 12 extends parallel to the cutting edges 3 of the razor blades 2 and has a step-shaped profile. Toward the rear, the upper part 5 is formed as a protective cover 10. The upper surface of the cover 10 is provided with a glide strip 13 that is convexly curved and thus covers the entire forward region of the protective cover 10, the bend of the intermediate region, and a portion of the rear side of the razor blade unit. The glide strip 13 is made by a hot form process and is glued to the protective cover 10. By means of the xerogel integrated in the glide strip 13, the latter becomes slippery when it comes into contact with water and considerably reduces frictional resistance.

The front guide strip 12 and the rear protective cover 10 are interconnected by side walls 14 that protectively accommodate the razor blades 2 between them in such a way that only the cutting edges 3 are exposed.

The present invention is, of course, in no way restricted to the specific disclosure of the specification and drawing, but also encompasses any modifications within the scope of the appended claims.

What I claim is:

1. In a razor head, said razor head including a plastic body having a front guide strip and a rear protective cover, with razor blade means, which comprise at least one blade made of steel, being fixedly disposed in said plastic body, and with said razor blade means being protected by protective wire means that extend over cutting edges of said blade means, the improvement wherein:

said at least one blade of said razor blade means comprises a steel strip having a width of less than 5 mm, a thickness between 0.05 and 0.25 mm, and a chromium/molybdenum steel composition having a hardness of greater than 620 HV and a retained austenite content of less than 32%, with each blade being a single piece that has no perforations, bores, and holes and is mounted in a vibration-free manner in said plastic body; and said protective wire means comprises a wire loop arrangement, with individual loops thereof being spaced greater than 2 mm apart but less than 5 mm apart and having a minimum wire thickness of greater than 0.1 mm to form a protective guard means over said razor blade means with the effect of a protective foil.

2. A razor head according to claim 1, in which said steel strip of said razor blade means has a width of less than 3 mm and thickness of 0.1 mm; and in which said loops of said protective wire means of said protective guard means are spaced approximately 3 mm apart.

3. A razor head according to claim 2, in which said individual loops of said protective wire means are disposed parallel to one another, are arranged exclusively over said razor blade means, and are made from stainless steel X 46 Cr 13.

4. A razor head according to claim 2, in which said steel strip of said razor blade means has an alloy composition comprising:

0.45 to 0.55% by weight carbon,
12.00 to 14.00% by weight chromium,
0.40 to 1.00% by weight silicon,
0.50 to 1.00% by weight manganese,
1.00 to 1.60% by weight molybdenum,
with the rest being iron and inevitable impurities, whereby via a heat treatment the steel has a hardness of greater than 620 HV.

5. A razor head according to claim 4, in which said alloy composition comprises:

0.5% by weight carbon,
13.58% by weight chromium,
0.90% by weight silicon,
0.79% by weight manganese,
1.30% by weight molybdenum,
with the rest being iron and inevitable impurities, whereby austenization is carried out at a temperature between 1075° and 1120° C. followed by quenching at a temperature between minus 60° and minus 80° C. for hardening followed by tempering at a temperature between 180° and 400° C.

6. A razor head according to claim 4, in which a layer comprised of a material selected from the group consisting of polytetrafluoroethylene and silicone is applied and sintered to said razor blade means.

7. A razor head according to claim 4, in which said steel strip of said razor blade means has a retained austenite proportion that decreases with the depth of said strip, being 24 to 32% at the surface and between 6 and 14% at a depth of 50 $\mu$m below the surface, with a carbide content in a structure of said strip being 100 to 150 particles per 100 $\mu m^2$.

8. A razor head according to claim 4, in which said protective cover is provided with a glide strip that is convexly curved to additionally cover an intermediate portion of said protective cover as well as a rear side of said plastic body, with said glide strip containing a lubricant in the form of a xerogel that upon contact with water as a dispersion medium is converted into a lyogel that is very lubricious on the skin of a user and has a coefficient of friction $\mu$ of less than 0.25.

* * * * *